United States Patent [19]

Polando

[11] Patent Number: 4,836,557

[45] Date of Patent: Jun. 6, 1989

[54] GAME TRACKING ARROW

[76] Inventor: Scott A. Polando, 137 Waterview, Lake Orion, Mich. 48035

[21] Appl. No.: 177,340

[22] Filed: Apr. 4, 1988

[51] Int. Cl.[4] ..... F41B 5/02

[52] U.S. Cl. ..... 273/416

[58] Field of Search ..... 273/416, 418, 419, 420–422; 43/6

[56] References Cited

U.S. PATENT DOCUMENTS

| | | | |
|---|---|---|---|
| 3,059,370 | 10/1962 | Moore | 43/19 |
| 3,150,875 | 9/1964 | Searles | 273/418 |
| 3,227,454 | 1/1966 | Ellenburg | 273/419 |
| 3,417,994 | 12/1968 | Rohrbaugh, Jr. | 273/418 |
| 3,790,948 | 2/1974 | Ratkovich | 273/420 X |
| 3,893,866 | 7/1975 | Hollingsworth | 273/418 |
| 3,945,642 | 3/1976 | Henthorn, Jr. | 273/421 X |
| 4,252,325 | 2/1981 | Weems et al. | 273/416 |
| 4,309,974 | 1/1982 | Carter et al. | 124/23 R |
| 4,378,781 | 4/1983 | Shiflett | 273/416 X |
| 4,557,243 | 12/1985 | Eastman et al. | 124/88 |
| 4,651,999 | 3/1987 | Sturm | 273/416 |
| 4,675,683 | 6/1987 | Robinson et al. | 273/416 X |
| 4,704,612 | 11/1987 | Boy et al. | 273/416 X |
| 4,744,347 | 5/1988 | Dodge | 273/416 X |
| 4,772,029 | 9/1988 | Watkins | 273/416 |

*Primary Examiner*—Paul E. Shapiro

*Attorney, Agent, or Firm*—Basile Hanlon

[57] ABSTRACT

A game tracking arrow includes a two-part, separable tracking device mountable between the broadhead and the shaft of an arrow. The first part or member of the tracking device is in the form of a hollow, tubular housing threadingly attachable at one end to the broadhead. A stop is connected to the second member or stud which is threadingly mounted to and extends outward from one end of the arrow shaft. A collar is formed intermediate the ends of the second member and has a cross section larger than the cross section of the housing. A spool of line is disposed within the housing and is connected at one end to the stud. The stop is separable from the housing when the collar stops penetration of the shaft into the game to cause separation of the stop from the housing and broadhead embedded within the animal enabling the shaft to fall to the ground and the line to unwind from the spool as the game moves from the location of the shaft on the ground. In one embodiment, a plurality of resilient fingers are formed adjacent the second end of the first member and retain the stop to separably attach the second member to the first member. In another embodiment, a biasing member is mounted on the second member and is compressible between the second member and the side wall of the first member to enable sliding retention of the second member in the first member.

15 Claims, 2 Drawing Sheets

GAME TRACKING ARROW

BACKGROUND OF THE INVENTION

1. Field of the Invention

The present invention relates, in general, to arrows and, more specifically, to arrows having means for tracking the arrow after it is released from a bow.

2. Description of the Prior Art

In hunting game with a bow and arrow, the hunter is faced with the task of tracking the game after hitting it with the arrow. Although the animal may be fatally wounded, it normally runs a considerable distance before dropping. In view of the dense trees, brush and undergrowth common in hunting areas, the task of locating a wounded animal is difficult and, in many instances, the hunter is unable to track and locate the wounded animal.

To overcome this problem, various arrow tracking devices have been devised. Such devices utilize a string attached at one end to the arrow via a clip and at another end contained in a spool or pay-out device mounted on the archery bow. A spool of string has also been directly mounted within the arrow and attached to a weight initially carried by the arrow which falls from the arrow under the acceleration forces when the arrow is released from the bow thereby leaving a string trail from the hunter to the location of the arrow.

However, the effectiveness of such arrow tracking devices requires that the arrow remain in the game after it strikes the game. Unfortunately, such is not usually the case. Due to the dense trees, brush and undergrowth common in hunting areas, the arrow frequently becomes dislodged from the animal as the animal runs wildly through the woods after being struck by the arrow. Further, some animals, such as deer, are known to purposely take action to remove the arrow themselves from their body. In either case, the arrow, after striking the animal, falls to the ground and, the tracking device, while enabling the hunter to retrieve his arrow, does nothing to assist him in locating the game which he has hit.

Also, the attachment of the string to the bow exerts a drag or load on the arrow which alters its flight characteristics and could cause it to miss its target unless adjustments are made by the hunter. Further, the spool or pay-out device attached to the bow effects the overall balance of the bow and could result in inaccuracies in aiming and shooting the arrow.

A somewhat different approach has been taken in the arrow string tracking apparatus shown in U.S. Pat. No. 4,651,999. In this device, the spool of string is housed in the shaft of the arrow along with a hook or catch device. The string is attached at one end to the arrow point and, when the arrow passes completely through the animal, unwinds from the spool housed within the shaft lodged within the animal which remains lodged in the animal by the hook thereby leaving a trail from the arrow point to the game. However, this device requires that the arrow pass completely through the animal so that the hook, which remains lodged in the animal, causes the point to separate from the shaft to unwind the string. In the event that the arrow point remains lodged in the game along with the shaft, no separation takes place and no string trail is provided for the hunter.

Thus, it would be desirable to provide a tracking device which enables a hunter to track game which he has struck with an arrow. It would also be desirable to provide an arrow tracking device which remains attached to the game after striking the game thereby providing a trail for the hunter to follow to the game. It would also be desirable to provide an arrow tracking device which is usable with a conventional broadhead arrow. It would also be desirable to provide an arrow tracking device which does not alter the balance of the bow during aiming and shooting or place any load or weight on the arrow during its flight. Finally, it would be desirable to provide an arrow tracking device which does not involve any reloading of the tracking device for the next attempt to shoot at a target.

SUMMARY OF THE INVENTION

The present invention is a game tracking arrow which provides an easily locatable trail to aid the hunter in locating game struck by an arrow. The game tracking arrow includes a two-part, separable tracking device mountable between the point and shaft of a conventional broadhead arrow. The first part or member of the game tracking arrow is in the form of a hollow, tubular housing which is threadingly attachable at one end to the broadhead point and contains a hollow, internal cavity.

The second member or stud has first and second ends with the first end being attached to one end of the arrow shaft. A collar is formed intermediate the second member and has a larger diameter than the cross section of the housing to prevent penetration of the shaft into the game. Means are provided for separably attaching the second end of the second member to the second end of the first member.

Line means in the form of an unwindable spool of line is housed within the internal cavity within the housing, with one end attached to the stud. The line means forms a readily identifiable trail between the broadhead arrow point and housing which remains embedded within the animal and the shaft and attached second member which separates from the housing when the collar contacts the hide of the animal and falls to the ground causing the line to unwind from the spool as the animal moves from the area where it struck. Alternately, the line means may be disposed internally within the shaft, with one end attached to the housing threadingly attached to the point of the arrow.

In one embodiment, the attaching means comprises a plurality of circumfrentially spaced, resilient fingers formed at the second end of the first member. Each of the fingers has an enlarged end portion defining a first diameter aperture therebetween opening into the interior of the first member. A stop is formed ajacent the second end of the second member and has a cross section larger than the cross section of the first diameter aperture in the housing so as to enable the second member to slidably fit through the aperture in the first member and be retained in the housing and yet is forceably separable from the fingers in the first member to separate the first and second members as the collar stops penetration of the shaft into the game. In an alternate embodiment, the attaching means includes biasing means mounted on the second member between the second end and the collar. The biasing means has an outside diameter slightly larger than the inside diameter of the first member so as to be compressed when urged into the first member to releasably retain the second member in the first member and yet allows separation of the second member from the first member when the collar stops penetration of the second member and attached arrow shaft into the game. Perferably, the biasing means is in the form of a generally C-shaped ring having spaced ends and a circular cross section which compressibly fits within a recess formed in the second member.

The game tracking arrow of the present invention overcomes many of the problems encountered with previously devised arrow tracking devices in that it provides a clearly identifiable trail for a hunter to follow to locate game struck by an arrow. Since only the arrow point and the short length housing attached thereto remain embedded within the animal, with the shaft and attached stud falling to the ground as the arrow point penetrates the skin of the animal, the line extending between the housing and stud remains connected to the animal thereby providing a trail from the fallen arrow shaft to the animal regardless of the distance or direction the animal takes after being struck by the arrow. This overcomes the problem with previous arrow tracking devices which are rendered useless when the arrow is dislodged from the animal.

Further, the lightweight construction of the housing and stud which are readily attachable to a conventional broadhead arrow do not unduly influence the flight characteristics of the arrow thereby providing its ready use in a known manner by a bow and arrow hunter. Further, since the line is housed internally within the arrow and is unwound only after the arrow has struck the game or animal, the line provides no load or drag on the arrow during its flight as with previously devised arrow tracking devices.

Finally, since the tracking device is housed internally within an arrow and separate from any attachment to the bow, the hunter may prepare several arrows at one time with the game tracking meaning of this invention thereby enabling him to rapidly shoot successive arrows without reloading a new spool of line and attaching it to the bow as with previous arrow tracking devices in the event that an arrow misses its target or another target quickly presents itself to the hunter. The simplifies the hunting process since no reloading is necessary and thereby overcomes a significant problem with previously devised arrow tracking devices as evidenced by repeated attempts to improve or simplify the reloading of a new spool of tracking line on the bow and attaching it to the arrow.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
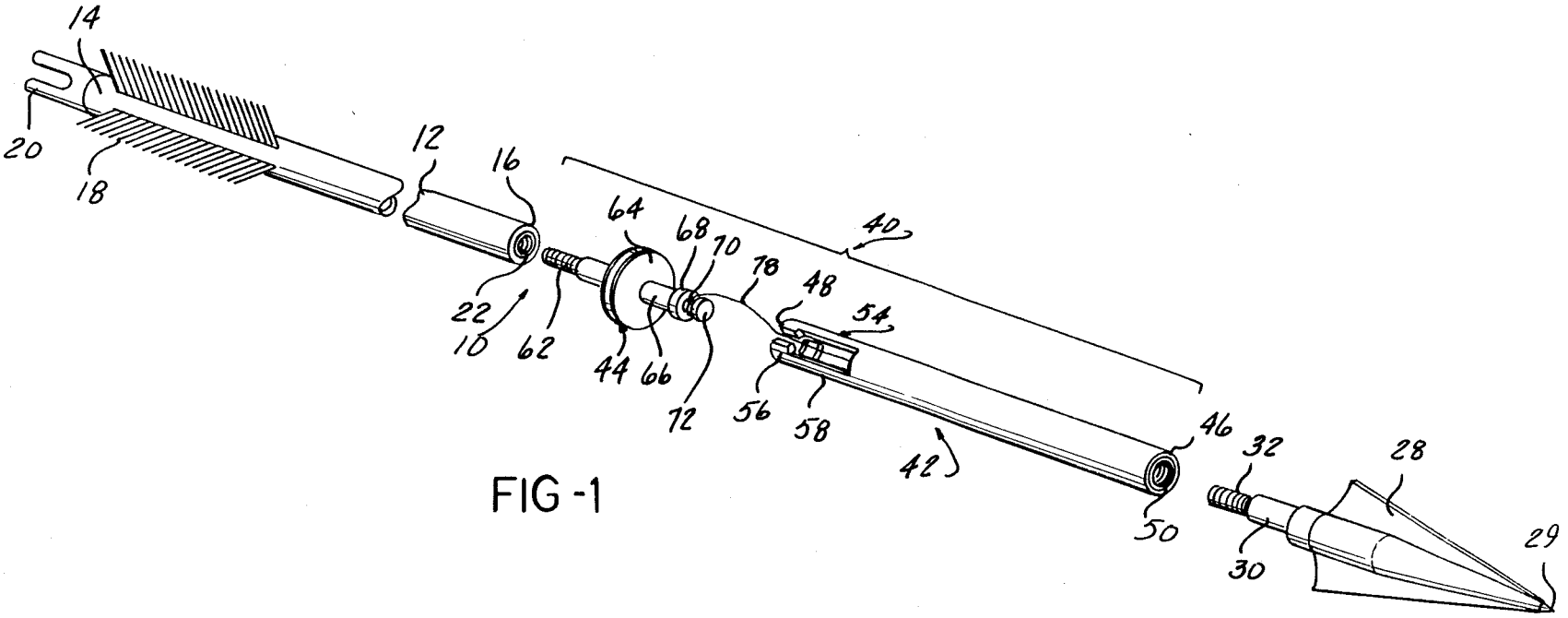
FIG. 1 is an exploded, perspective view of the game tracking arrow of the present invention.

Throughout the following description and drawing, an identical reference number is used to refer to the same component shown in multiple figures of the drawing.

Referring now to the drawing, and to FIG. 1 in particular, there is illustrated a game tracking arrow 10 constructed in accordance of the teachings of the present invention which provides an easily identifiable trail for the hunter to follow when tracking game struck by the arrow 10.

The arrow 10 is of conventional construction and includes a shaft 12. The shaft 12 has a hollow, tubular shape and is formed of a suitable lightweight material, such as aluminum, fiberglass or plastic. Wood many also be used to form the shaft 12 as long as the shaft 12 is provided with the connection point means described hereafter.

A first end 14 of the arrow shaft 12 is provided with a plurality of circumfrentially spaced fletching veins or flight directing feathers 18. A nock 20 is mounted at the first end 14 of the shaft 12 of engagement with a bow string in a known manner.

The second end 16 of the shaft 12 is provided with a plurality of internally disposed threads. In a preferred embodiment, a ferrule 22 is adhesively mounted within the second end 16 of the shaft 12. The ferrule 22 includes, as shown in greater detail in FIG. 2, a first hollow bore 26 and contiguous therewith, a plurality of internal threads 24. The threads 24 are size to threadingly receive threads mounted on a conventional broadhead point 28.

The broadhead point 28 is of conventional construction and includes a point or tip 29 at one end. The opposite end of the broadhead 28 is formed with an elongated shaft 30 having a plurality of external threads 32 which are normally engageable with the shaft 12 to mount the broadhead 28 on the shaft 12.

Figure 2:
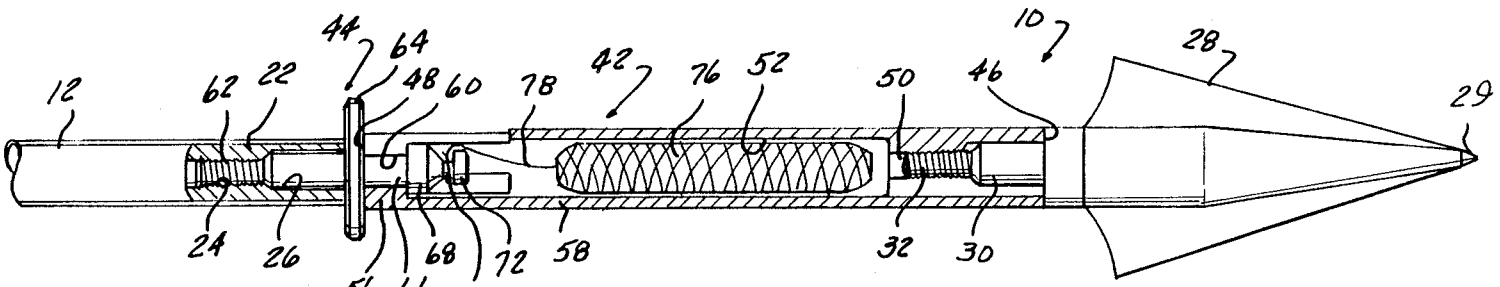
FIG. 2 is a partial, side elevational view of the game tracking arrow shown in FIG. 1, with a portion of the side wall of the housing and shaft removed showing the interiorally disposed elements thereof.

The game tracking arrow 10 of the present invention includes game tracking means denoted in general by reference number 40 in FIGS. 1 and 2. The tracking means 40 comprises a first member or housing 42 and a second member or an elongated stud 44.

Figure 3:
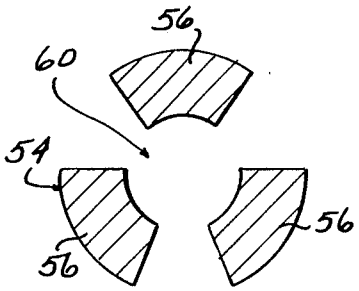
FIG. 3 is a cross sectional view generally taken along line 3—3 on FIG. 4.

As shown in FIGS. 1, 2 and 3, the housing 42 has an elongated, tubular, hollow form. Preferably, the housing 42 is formed of a lightweight material, such as plastic. Alternately, the housing 42 may be formed of a lightweight metallic material, such as aluminim.

The first end 46 of the housing 42 is provided with a plurality of internally disposed threads 50 which threadingly receive the threads 32 on the shaft 30 of the broadhead 28 to mount the broadhead 28 to the housing 42. It should be noted that the threads 50 formed adjacent the first end 46 of the housing 42 may be formed integrally in the housing 42 or may be provided by means of an insertable ferrule mounted within the first end 46 of the housing 42.

As also shown in FIG. 2, an internal cavity 52 is formed within the housing 42 between the solid side walls for reasons which will be described in greater detail hereafter.

The opposite or second end 48 of the housing 42 terminates in a plurality of circumfrentially spaced, elongated, resilient fingers 54. The end portions 56 of each of the fingers 54 is formed as an enlarged tip which merges into a narrow cross section shank portion 58 which is an integral extension of the solid side walls of the housing 42. The circumfrentially spaced enlarged end portions 56 of the fingers 54 form a first diameter aperture therebetween. The first diameter aperture opens into a larger diameter bore between the shank portions 58 of the fingers 54.

The stud 44 is preferably in the form of a solid member, preferably of plastic or a lightweight metal, such as aluminum, having a first end 62 formed with a plurality of threads which threadingly engage the threads 24 in the ferrule 22 in the second end 16 of the shaft 12. A collar 64 is formed intermediate the ends of the stud 44 and has a cross section larger than the cross section of the housing 42 such that the peripheral edges of the collar 64 extend outward beyond the peripheral surface of the housing 42.

A shaft 66 extends contiguously from one side of the collar 64 and merges into a stop 68. The stop 68 has a cross section larger than that of the shaft 66 and forms a flange on its face 69 adjacent the shaft 66. The opposite end of the stop 68 from the face 69 tapers into a short shaft 70 which terminates in a end knob 72.

The short shaft 66 has a cross section or diameter approximate the diameter of the aperture formed between the ends 56 of the circumfrentially spaced fingers 54 on the housing 42 so as to slidably extend therethrough when the stud 44 is attached to the housing 42 as described hereafter. However, due to the enlarged shape of the stop 68, the face 69 of the stop 68 engages the inside edge of the enlarged end portion 56 of the fingers 54 and is releasably retained therein to attach the stud 44 to the housing 42.

The stop 68, collar 64 and fingers 54 cooperate to form one embodiment of means for separably attaching the second end of the stud 44 to the second end of the housing 42.

Due to the resilient nature of the fingers 54, the stop 68 may be forceably separated from the housing 42 urging the fingers 54 outward from the longitudinal axis of the housing 42 to separate the stud 44 and the attached arrow shaft 12 from the housing 42 and attached broad point 28.

Line means, denoted in general by reference number 76 in FIG. 2, is disposed within the cavity 52 in the housing 42. The line means 76 is preferably in the form of a spool of line, string, cord, yarn or any other flexible material, which may be unwound as described hereafter. Preferably, the spool 76 of line is centerwound, that is, the loose end of the spool 76 pays out from the center of the spool 76.

The loose end 78 of the spool 76 is tied or otherwise secured about the short shaft 70 on the stud 44 as shown in FIGS. 1 and 2. This connects the line 76 to the stud 44, both when the housing 42 is attached to the stud 44 and when the housing 42 is separated from the stud 44.

In assembling the game tracking arrow 10 of the present invention, the spool of line 76 is inserted into the interior cavity 52 in the housing 42. One end 78 of the line 76 is attached to the stud 44 about the short shaft 70. The stud 44 is then threadingly inserted into the second end 16 of the shaft 12. Finally, the broadhead 28 is threaded into the first end 46 of the housing 42.

Figure 4:
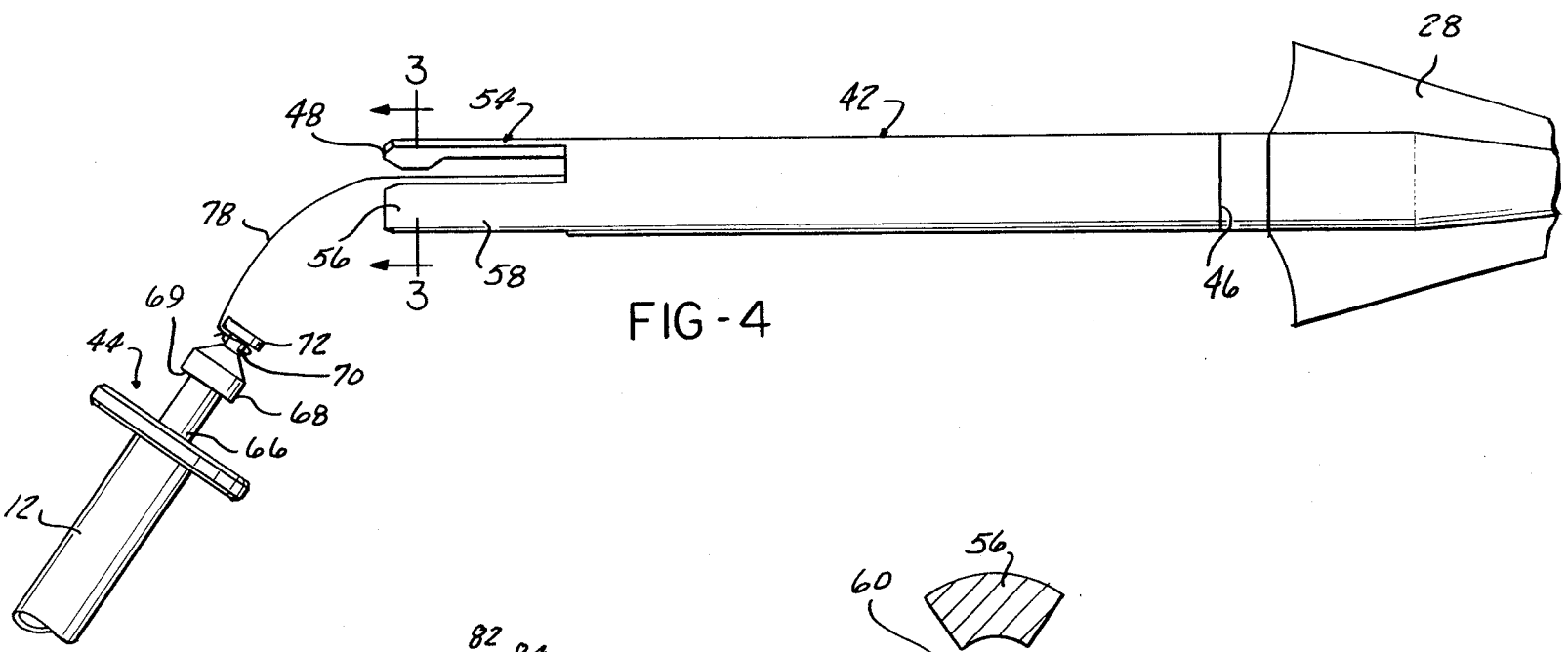
FIG. 4 is an exploded, side elevational view of the game tracking arrow of the present invention showing the position of the components thereof after the arrow has struck a target.

In use, as shown in FIG. 4, the arrow 10, after assembly, is shot in a normal manner from an archery bow. As the arrow 10 strikes a target, such as an animal, the broadhead 28 penetrates the skin of the animal. The arrow 10 continues to penetrate the animal until the collar 64 contacts the skin or hide of the animal thereby stopping further penetration of the shaft 12 into the animal.

However, the force of impact causes the broadhead 28 and shaft 42 to continue to penetrate into the animal causing the fingers 54 to move outward from the longitudinal axis of the housing 42 enabling the stop 68 to slide outward from the housing 42 to separate the shaft 12 from the broadhead 28.

In so doing, the shaft 12 and attached stud 44 fall to the ground as shown in FIG. 4 unwinding the line 78 from the spool housed within the housing 42 whcih remains embedded within the animal. Thus, despite wherever the animal goes after being struck by the arrow 10, the line continues to pay out from the position of the shaft 12 on the ground to the animal's location thereby providing a readily identifiable trail for the hunter to follow to the game.

It should be noted that although the tracking line 76 has been described and illustrated as being contained within the housing 42 attached to the broadhead 28, it could just as easily have been mounted within the shaft 12 of the arrow with a suitable connection of its loose end to the housing 42 to provide the same tracking features of the game tracking arrow 10 described above.

Figure 6:
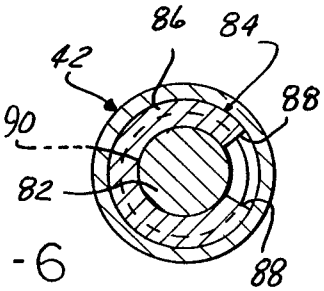
FIG. 6 is a cross sectional view generally taken along line 6—6 in FIG. 5.
Figure 5:
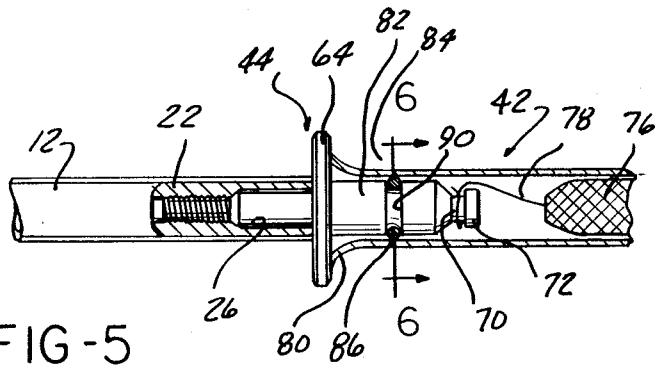
FIG. 5 is a partial, side elevational view showing an alternate embodiment of the attaching means used to releasably attach the first and second members of the game tracking arrow of the present invention together.

Referring now to FIGS. 5 and 6, there is illustrated an alternate embodiment of a means for separably attaching the second member or stud 44 to the first member or housing 42. In this embodiment, the second end of the housing 42 is a continuous extension of the side walls of the housing 42 and is flared radially outward as shown by reference number 80 to form an inwardly tapering surface for convenient insertion of the line means 76 as well as the end of the stud 44 into the interior of the housing 42. The stop 82 has a continuous cross section from its one end joined to the collar 64 to its opposed end which tapers to the short shaft 70 and knob 72.

Biasing means denoted in general by reference number 84 is provided for biasingly attaching the stud 44 to the housing 42 and yet allow separation of the stud 44 and attached arrow shaft 12 from the housing 42 and attached broad point 28 when the collar 64 engages the skin or hide of the game preventing penetration of the stud 44 and arrow shaft 12 into the game as described above. The biasing means 84 is preferably in the form of a compressible ring 86 which is mounted in a recess 90 formed on the stop 82 between the collar 64 and the second end of the stud 44. The C-shaped ring 86 which may be formed of compressible material or spring steel has spaced ends 88 and a generally circular cross section. The C-shaped ring 86 also has an outer diameter slightly larger than the inside diameter of the housing 42. This enables the ring 86 to be compressed as the stud 44 on which it is carried is slidingly inserted into the second end of the housing 42 and yet frictionally retain the stud 44 and attached arrow shaft 12 within the housing 44. However, the high forces imparted when the collar 64 strikes the skin of the game preventing penetration of the collar 64 and attached stud 44 into the game enables the stud 44 to be slidably separated from the housing 42 separating the arrow shaft 12 from the housing 42 and broad point 28 in the same manner as described above.

In summary, there has been disclosed a unique game tracking arrow which provides a readily identifiable trail for the hunter to follow to locate game struck by an arrow. The game tracking arrow of the present invention contains a spool of line housed within a housing attached to the broadhead point of the arrow which is separably attached via a stud to the arrow shaft. In this manner, the flight of the arrow after being shot remains unaffected; yet a readily identifiable trail is provided for the hunter to follow from the shaft on the ground to the animal.

What is claimed is:

1. A game tracking apparatus for an arrow having a shaft and a point, the game tracking apparatus comprising:

first and second separably attachable members mountable between the shaft and the point of an arrow;

the first member having first and second ends, the first end being attachable to the narrow point;

the second member having first and second ends, the first end being attachable to the shaft of an arrow, a collar formed intermediate the first and second ends of the second member, the collar having a cross section larger than the cross section of the first member;

means for separably attaching the second member to the first member; and line means disposed within one of the first and second members, the line means having a first end secured to the other of the first and second members to move with the game after the point of an arrow and the first member attached thereto have penetrated the game and the shaft and the second member have separated from the point and the first member to track the location of the game from the location of the shaft.

2. The game tracking apparatus of claim 1 wherein:

the first member is hollow; and the line means is disposed within the first member.

3. The game tracking apparatus of claim 1 wherein the shaft includes a plurality of internal threads adjacent one end;

the point includes a plurality of external threads;

the first member is threadingly attachable to the threads on the point; and the second member is threadingly attachable to the threads in the shaft.

4. The game tracking apparatus of claim 1 wherein the means for separably attaching the second member to the first member comprises:

a plurality of circumfrentially spaced, resilent fingers formed at the second end of the first member, the fingers having an enlarged end portion defining a first diameter aperture therebetween opening into the first member; and a stop formed adjacent the second end of the second member, the stop having a cross section larger than the cross section of the first diameter aperture in the first member to slidably fit through the aperture in the first member and be retained therein, yet being forceably separable from the fingers in the first member to separate the first and second members.

5. The game tracking apparatus of claim 4 wherein the plurality of fingers includes three circumfrentially spaced fingers, each finger being formed with an elongated shank integrally extending from one end of the housing and defining a first diameter bore therebetween;

the enlarged end portions of each of the fingers defining the first diameter aperture therebetween which is smaller in cross section than the first diameter bore between the shank portions of the fingers.

6. The game tracking apparatus of claim 1 wherein the mans for separably attaching the second member to the first member comprises:

biasing means, mounted on the second member between the collar and the second end of the second member, for biasingly engaging the first member as the second member is inserted into the first member to separably attach the second member to the first member and yet allow sliding separation of the second member from the first member when the collar engages the game and prevents penetration of the second member and the attached shaft into the game.

7. The game tracking apparatus of claim 6 wherein the biasing means comprises:

a compressible ring mounted on the second member, the ring having a normal outside diameter slightly larger than the inside diameter of the first member.

8. A game tracking apparatus for an arrow having a shaft with an internally threaded first end and a point with a threaded shaft, the game tracking apparatus comprising:

first and second separably attachable memebers, each threadingly attachable to the point and the shaft, respectively;

the first member having first and second ends, the first end being threadingly attachable to the point, the second end including a plurality of circumfrentially spaced, resilient fingers, each of the fingers having an enlarged end portion defining in combination a first diamter aperture therebetween, the first member having a hollow internal cavity;

the second member having first and second ends, the first end being threadingly attachable to the shaft;

a collar formed intermediated the first and second ends of the second member, the collar having a cross section larger than the cross section of the first member;

a stop formed adjacent the second end of the second member, the stop having a cross section larger than the cross section of the first diameter aperture between the circumfrentially spaced fingers in the first member to slidingly fit within the first member and be retained by the fingers to attach the second member and the attached shaft to the first member and the attached point, the stop being foreably separable from the fingers as the collar engages the game after the point and the first member have been embedded within the game to release the shaft from the first member and point; and line means in the form of an unwindable spool disposed within the cavity in the first member, one end of the line means being attachable to the second member to provide an definable trail from the point embedded within the game to the shaft separated from the point after the arrow has struck the game.

9. A game tracking arrow comprising:

a hollow shaft;

a point;

first and second separably attachable members mountable between the shaft and the point of the arrow;

the first member having first and second ends, the first end being attached to the point;

the second member having first and second ends, the first end being attached to the shaft, a collar formed intermediate the first and second ends of the second member, the collar having a cross section larger than the cross section of the first member;

means for separably attaching the second member to the first member; and line means disposed within one of the first and second members, the line means having a first end secured to the other of the first and second members to move with the game after the point and the first member have penetrated the game and the shaft and the second member have separated from the point and the first member to track the location of the game from the location of the shaft.

10. The game tracking arrow of claim 9 wherein:

the line means is disposed within the first member.

11. The games tracking arrow of claim 10 wherein:

the shaft includes a plurality of internal threads adjacent one end;

the point includes a plurality of external threads;

the first member includes threads adjacent the first end thereof which are threadingly engageable with the threads on the point; and the second member includes a plurality of threads adjacent the first end thereof which are threadingly engageable with the threads in the shaft.

12. The games tracking arrow of claim 9 wherein the means for separably attaching the second member to the first member comprises:

a plurality of circumfrentially spaced, resilient fingers formed at the second end of the first member, the fingers having an enlarged end portion defining a first diameter aperture therebetween opening into the first member; and a stop formed adjacent the second end of the second member, the stop having a cross section larger than the cross section of the first diameter aperture in the first member to slidably fit through the aperture in the fist member and be retained therein, yet being forceably separable from the fingers in the first member to separate the first and second members.

13. The game tracking arrow of claim 12 wherein the plurality of fingers includes three circumfrentially spaced fingers, each finger being formed with an elongated shank integrally extending from one end of the first member and defining a first diameter bore therebetween; and the enlarged end portions of each of the fingers defining the first diameter aperture therebetween which is smaller in cross section than the first diameter bore formed between the shank portions of the fingers.

14. The game tracking arrow of claim 9 wherein the means for separably attaching the second member to the first member comprises:

biasing means, mounted on the second member between the collar and the second end of the second member, for biasingly engaging the first member as the second member is inserted into the first member to separably attach the second member to the first member and yet allow sliding separation of the second member from the first member when the collar engages the game and prevents penetration of the second member and the attched shaft into the game.

15. The game tracking arrow of claim 14 wherein the biasing means comprises:

a compressible ring mounted on the second member, the ring having a normal outside diameter slightly larger than the inside diameter of the first member.

* * * * *